US008588637B2

(12) United States Patent
Nakamura et al.

(10) Patent No.: US 8,588,637 B2
(45) Date of Patent: Nov. 19, 2013

(54) IMAGE FORMING APPARATUS WITH ROLLER FORMED IN INVERTED CROWN SHAPE

(75) Inventors: Masakazu Nakamura, Hino (JP); Susumu Okui, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 271 days.

(21) Appl. No.: 13/079,971

(22) Filed: Apr. 5, 2011

(65) Prior Publication Data

US 2011/0249993 A1 Oct. 13, 2011

(30) Foreign Application Priority Data

Apr. 8, 2010 (JP) ..... 2010-089394

(51) Int. Cl.
*G03G 15/16* (2006.01)
*G03G 15/01* (2006.01)

(52) U.S. Cl.
USPC ..... 399/66; 399/302

(58) Field of Classification Search
USPC ..... 399/302, 66, 121
See application file for complete search history.

(56) References Cited

U.S. PATENT DOCUMENTS 4,407,580 A * 10/1983 Hashimoto et al. ..... 399/313
5,450,185 A * 9/1995 Kuribayashi et al. ..... 399/350
5,678,161 A * 10/1997 Kurotaka et al. ..... 399/400
2005/0180767 A1* 8/2005 Ishii et al. ..... 399/66
2009/0010698 A1* 1/2009 Maruko et al. ..... 399/406

FOREIGN PATENT DOCUMENTS

JP 10-268655 A 10/1998
JP 2002-156808 A 5/2002
JP 2004325666 A 11/2004
JP 2005-345627 A 12/2005
JP 2008107421 A 5/2008
JP 2008-152149 A 7/2008
JP 2009-156980 A 7/2009

OTHER PUBLICATIONS

Notice of Reasons for Refusal for Japanese Patent Application No. 2010-089394; 4 pgs. with English Translation.

* cited by examiner

*Primary Examiner* — David Gray
*Assistant Examiner* — G. M. Hyder
(74) *Attorney, Agent, or Firm* — Cantor Colburn LLP

(57) ABSTRACT

An image forming apparatus including; an image carrier carrying a toner image; a transfer belt making pressure contact with the image carrier through a sheet of paper and transferring the toner image onto the sheet of paper; a plurality of supporting rollers stretching and supporting the transfer belt; and a transfer roller to which transfer electrical current is applied, as well as making pressure contact of the transfer belt with the image carrier from a back surface of the transfer belt, wherein at least one roller of the supporting rollers is formed in an inverted crown shape with a size of the center portion is smaller than a size of the end portion, and the transfer belt is rotationally driven for a prescribed time without applying transfer electrical current both or in either of before and after transfer of a toner image.

6 Claims, 3 Drawing Sheets

IMAGE FORMING APPARATUS WITH ROLLER FORMED IN INVERTED CROWN SHAPE

RELATED APPLICATION

The present application is based on Patent Application No. 2010-089394 filed at the Japan Patent Office on Apr. 8, 2010 and which is hereby incorporated herein in its entirety.

TECHNICAL FIELD

The present invention relates to an image forming apparatus of an electrophotographic system and, more particularly, to an image forming apparatus of a belt transfer method using a transfer belt when a toner image is transferred onto a sheet of paper.

BACKGROUND

In an image forming apparatus of an electrophotographic system, a formed toner image is transferred onto a sheet of paper using a transfer means. The transfer means includes various methods such as a charger method, a roller transfer method, and a belt transfer method. Of these methods, in recent years, adoption of the belt transfer method to a color image forming apparatus has been proposed in large numbers in terms of separation properties, and the like.

For example, Japanese Patent Application Publication No. H10-268655 proposes to resolve transfer failure such as white spots by making a part of rollers supporting a secondary transfer belt a conductive roller.

Also Japanese Patent Application Publication No. 2002-156808 proposes to press a secondary transfer belt against an intermediate transfer belt at an entrance of a transfer section, or to wind an intermediate transfer belt around a secondary transfer belt in order to resolve a problem caused by pretransfer occurred at an entrance of a transfer section.

Furthermore, Japanese Patent Application Publication No. 2009-156980 proposes to carry out electric discharge on the inside of a secondary transfer belt in order to prevent transfer nonuniformity.

The inventors of the present invention found that, when a long term durability test has been carried out using a tandem type color image forming apparatus adopting a belt transfer method, image failure and the like occurred and, in the case of significant failure, a situation of breakage of the secondary transfer belt occurred. Even if the proposals described in the above Patent Documents were adopted to solve the above problem, the problems such as the image failure were not resolved.

Therefore, as a result of our close examination, it was determined that the failure was caused by undulation of secondary transfer belt. It was found that the undulation was generated as if the undulation came together at the center of the belt from upstream of the belt travelling direction toward downstream, and the undulation phenomena occurred when transfer electrical current was applied. When the transfer electrical current was turned off, no such undulation was generated, and even if it was generated, the degree of the undulation was slight.

If such undulation is superimposed, the surface of the secondary transfer belt is distorted to result in image failure, and if the distortion is considerable, creep deformation (permanent deformation) is caused, which may lead to belt breakage.

Therefore, the purpose of the present invention is to provide an image forming apparatus in which image failure or belt breakage may not occur by resolving problems caused by undulation phenomena during application of transfer electrical current of a transfer belt.

SUMMARY

The above purpose can be achieved by providing a rotational driving period of a transfer belt without applying transfer electrical current, as well as making at least one roller of rollers supporting the transfer belt an inverted crown shape.

The transfer belt is attracted to a transfer roller side by attraction between electric charges induced on a back surface of the transfer belt and electric charges on the transfer roller. However, since both the transfer belt and the image carrier have a finite size in a width direction, electrostatic absorption power at a portion near the center and at a portion near the end in the width direction differs to each other. As a result of this, the portion near the center of the transfer belt is attracted more strongly to the transfer roller side, while the end portion of the transfer belt is not attracted so strongly. Therefore, at the portion near the center of the transfer belt, the amount of wrap of the transfer belt around the transfer roller increases compared to the end portion of the transfer belt, and as a result, tension of the transfer belt at the portion near the center also increases compared to that at the both ends. As a result, it was found that tension of the transfer belt became unequal in the belt width direction, and then, undulation is generated in such a way that the undulation heads from the both ends of the transfer belt, where the tension is relatively small, toward the portion near the center of the transfer belt, where the tension is relatively large. The transfer roller and the rollers supporting the transfer belt used for the above apparatus in which the long term durability test was carried out were rollers of cylindrical shape having the same size between the end portion and the center portion.

The present invention is to resolve the above problems by generating another undulation which cancels the above undulation generated during application of the transfer electrical current. Namely, when the transfer belt is rotated in a state that at least one roller of the rollers supporting the transfer belt is formed in an inverted crown shape, tension at end portions in the width direction of the transfer belt becomes larger than that at a center portion, to result in the transfer belt being stretched toward the end portions. As a result of this, undulation spreading from upstream in the traveling direction toward downstream is generated on the transfer belt, and this undulation cancels the undulation generated during application of the transfer electrical current. It is presumed that the undulation of the reverse direction may be generated also during application of the transfer electrical current, but, to surely carry out the cancellation, the driving is carried out even in a state where the transfer electrical current is not applied.

More specifically, the above purpose can be achieved by the constitution described below.

Item 1. To achieve at least one of the abovementioned objects, an image forming apparatus reflecting one aspect of the present invention includes an image carrier carrying a toner image; a transfer belt making pressure contact with the image carrier through a sheet of paper and transferring the toner image onto the sheet of paper, a plurality of supporting rollers stretching and supporting the transfer belt; and a transfer roller to which transfer electrical current is applied, as well as making pressure contact of the transfer belt with the image carrier from a back surface of the transfer belt, wherein at least one roller of the supporting rollers is formed in an inverted crown shape with a size of the center portion is smaller than a size of the end portion, and the transfer belt is rotationally driven for a prescribed time without applying transfer electrical current both or in either of before and after transfer of a toner image.

Item 2. In the abovementioned image forming apparatus of item 1, wherein, the inverted crown shaped supporting roller is a driving roller which rotationally drives the transfer belt.

Item 3. In the abovementioned image forming apparatus of item 1, wherein a modulus of elasticity of the transfer belt is 0.01 to 3 GPa.

Item 4. In the abovementioned image forming apparatus of item 1, further including a back up roller making a close contact with the back surface of the transfer belt at downstream of the transfer roller.

Item 5. In the abovementioned image forming apparatus of item 1, further including a back up board member making a close contact with the back surface of the transfer belt at downstream of the transfer roller.

Item 6. In the abovementioned image forming apparatus of item 1, wherein the image carrier is an intermediate transfer member carrying a color toner image in which toner images composed of a plurality of colors are superimposed.

DESCRIPTION OF THE PREFERRED EMBODIMENTS

Figure 1:
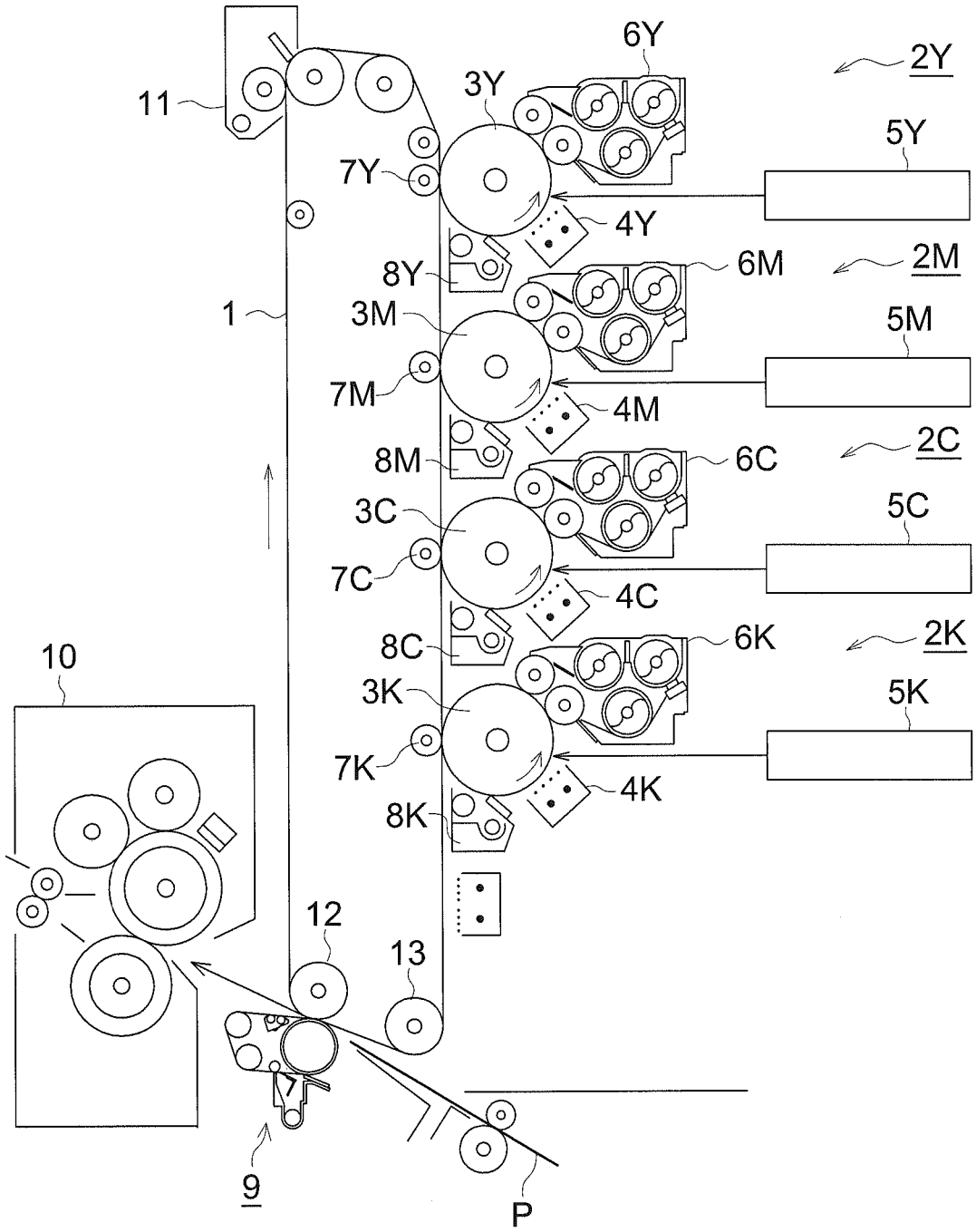
FIG. 1 is a schematic cross section of the image forming apparatus in which the present invention is applied.

The present invention will hereinafter be described with reference to the accompanying drawings. FIG. 1 is a schematic cross section of the image forming apparatus in which the present invention is applied, and the image forming apparatus is a color machine of a tandem system. The present invention can, of course, be applied to color or monochrome machines of other systems.

The image forming apparatus has, at its center, intermediate transfer belt 1 which is longitudinally wound about, and, on the right side of the intermediate transfer belt 1, arranged beginning from the top are yellow image forming unit 2Y, magenta image forming unit 2M, cyan image forming unit 2C, and black image forming unit 2K.

Since the constitution of each image forming unit is identical, the constitution is described as yellow image forming unit 2Y is a representative one. At the left end of yellow image forming unit 2Y, photoreceptor drum 3Y is arranged so as to be contacted with intermediate transfer belt 1, and, around this photoreceptor drum 3Y, arranged consecutively in the counterclockwise direction charging device 4Y, laser writing device 5Y, developing device 6Y, primary transfer roller 7Y (on the back of intermediate transfer belt 1), and cleaning device 8Y. In the following descriptions, the descriptions using a part number of each device without a symbol, Y, M, C, or K, are common for each color.

Photoreceptor drum 3 is uniformly charged by charging device 4, after which, based on image data from an image reading apparatus (not illustrated) or sent from a PC and like device, the image is written by laser writing device 5 on photoreceptor drum 3, resulting in a formation of an electrostatic latent image thereon. The electrostatic latent image is then converted to a toner image by developing device 6, and then, the image is transferred to intermediate transfer belt 1 by primary transfer roller 7.

When toner images composed of each color are superimposed on intermediate transfer belt 1, the resulting toner image is transferred to a sheet of paper P fed from a sheet feeding device (not illustrated) by transfer unit 9 which carrying out a secondary transfer. The toner image transferred to a sheet of paper is then fixed by fixing device 10, after which the sheet of paper is ejected outside the apparatus. After the transfer, intermediate transfer belt 1 is cleaned by belt cleaning device 11.

Figure 2:
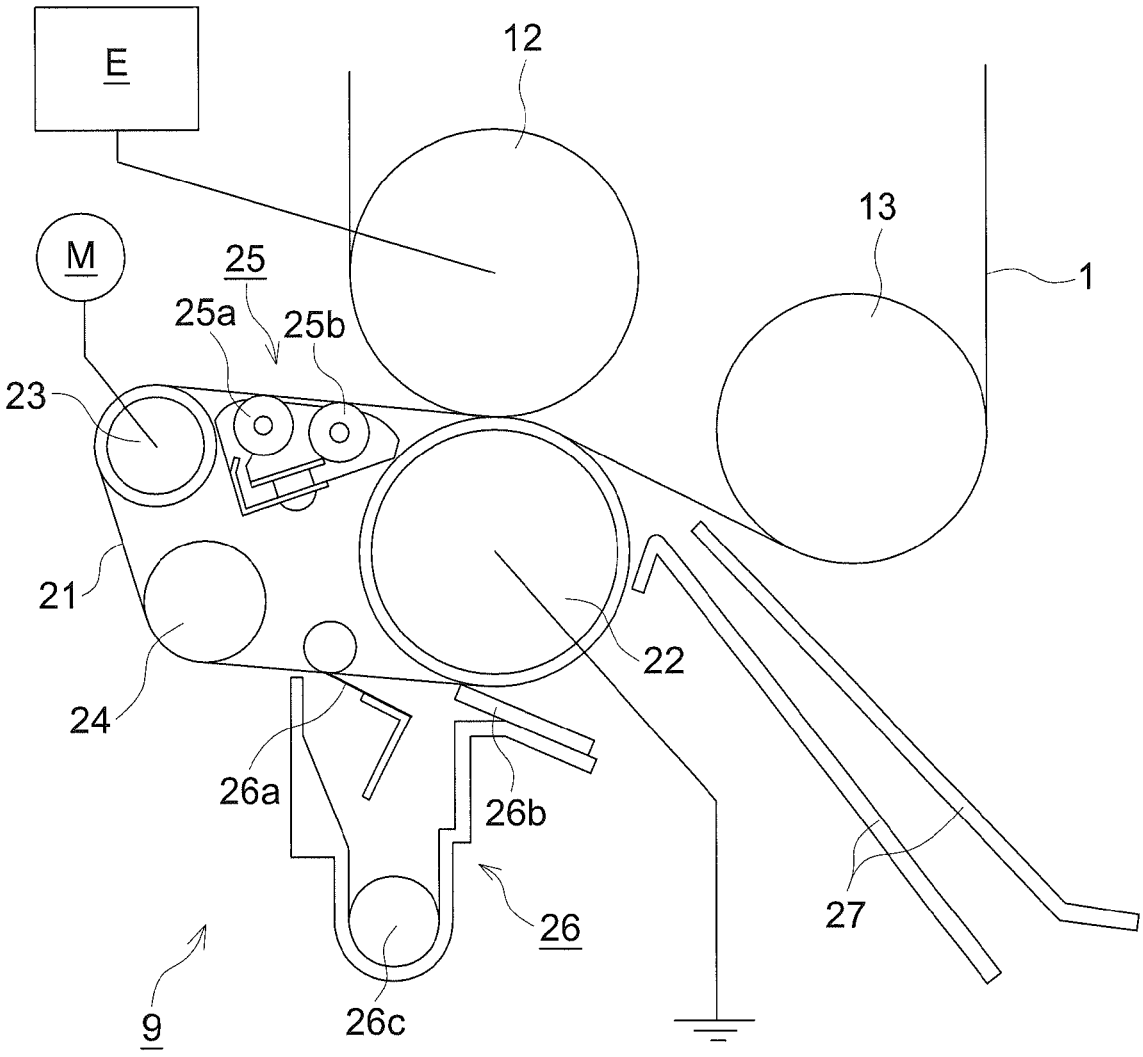
FIG. 2 is an enlarged cross-section of a main part of the transfer section of the image forming apparatus of the present invention.

FIG. 2 is an enlarged cross-section of a main part of the transfer section of the above image forming apparatus. In the embodiment, intermediate transfer belt 1 is stretched and supported by a plurality of supporting rollers, but FIG. 2 shows two supporting rollers, rollers 12 and 13. Of the two rollers, intermediate transfer belt 1 supported by supporting roller 12 makes a close contact with transfer unit 9.

Transfer unit 9 is composed of transfer belt 21; transfer roller 22, driving roller 23, and supporting roller 24 all of which rollers stretch and support the transfer belt; backup unit 25 making a close contact with the back surface of transfer belt 21 at downstream of the transfer region; and cleaning unit 26 cleaning the transfer belt. In upstream of the transfer region formed by this transfer unit 9 and intermediate transfer belt 1, located are two sheet guides 27 which guide sheets of paper. Power source E used for the application of transfer electrical current is connected with supporting roller 12 of intermediate transfer belt 1, and transfer roller 22 is electrically grounded. Further, driving source M rotationally driving transfer belt 21 is connected with driving roller 23.

Backup unit 25 holds two small size backup rollers 25*a* and 25*b* on a guide board, and urges the back surface of transfer belt 21 together with the guide board with a prescribed digging amount. This backup unit 25 may have such a configuration that a board member (a backup board member) is pushed against the back surface of transfer belt 21. This backup roller 25 fulfills a function of separating transfer belt 21 from transfer roller 22 and a function of suppressing undulation phenomenon. In the case of using a roller as backup unit 25, the roller is preferably an adequately small size roller compared to transfer roller 22, and the smaller the size of the roller, the closer the roller can be arranged to a position where transfer belt 21 is separated from transfer roller 22.

Cleaning unit 26 scrapes toner off the surface of transfer belt 21 using two cleaning members, scraper 26*a* made of a thin PPS (polyphenylene sulfide) resin and the like and elastic blade 26*b*, and then, transfers the toner from screw roller 26*c* located at a lower part of the unit to a bottle for waste toner (not illustrated).

Transfer belt 21 uses a semiconductor belt composed of a single layer of PVDF (polyvinylidene fluoride) resin. A modulus of elasticity of transfer belt 21 used in the embodiment is 1.2 GPa, but a belt having a modulus of elasticity of 0.01 to 3 GPa is usable. On the other hand, intermediate transfer belt 1 is a single layer belt made of PI (polyimide) resin.

The present invention is to solve a problem of undulation generated on transfer belt 21, and FIG. 3 is a schematic illustration describing this undulation phenomenon. Namely, FIG. 3*a* is a perspective view showing a state when the transfer electrical current is sent through transfer belt 21, and, as shown by an arrow, undulation W1 is generated in the direction in which it comes together at the center from upstream of the belt traveling direction toward downstream.

Figure 3A:
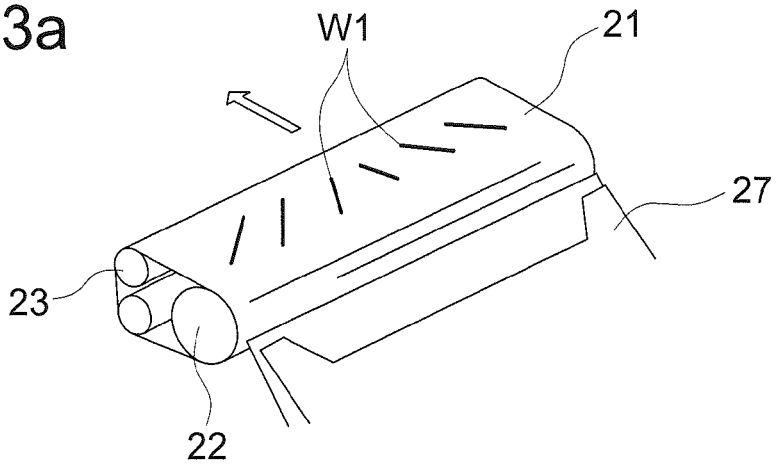
FIG. 3*a* is a schematic illustration describing the undulation phenomenon relating to the present invention.
Figure 3B:
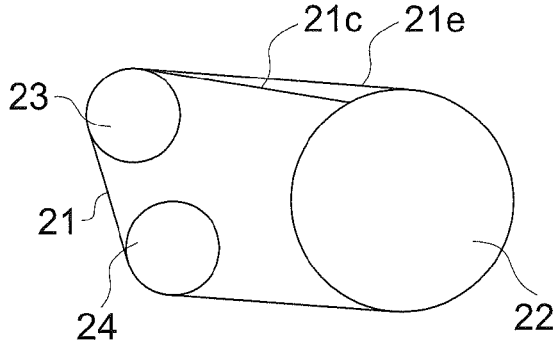
FIG. 3*b* is a cross-section illustration describing the cause of generation of this undulation W1.

The cause of generation of this undulation W1 will be described using a cross-section of FIG. 3*b*. Transfer belt 21 is attracted to transfer roller 22 side by attraction between electrical current sent through on a back surface of transfer belt 21 and electric charges on transfer roller 22. However, since transfer belt 21 and an image carrier have a finite size in a width direction, electrostatic absorption power at a portion near the center and at a portion near the end in the width direction differs to each other. As a result of this, the portion near the center of transfer belt 21 is attracted more strongly to transfer roller 22 side, while end portion 21*e* of transfer belt 21 is not attracted so strongly. Therefore, at the portion near center of transfer belt 21*c*, the amount of wrap of transfer belt 21 around transfer roller 22 increases compared to end portion of transfer belt 21*e*, and as a result, tension at the portion near the center of transfer belt 21 also increases compared to the both ends of the belt. As a result, tension of transfer belt 21 becomes unequal in the belt width direction, and then, undulation is generated in such a way that the undulation heads from both ends 21*e* of the transfer belt, where the tension of transfer belt 21 is relatively small, toward portion near center 21*c*, where the tension is relatively large.

Figure 3C:
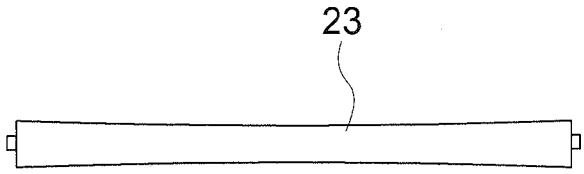
FIG. 3*c* is an illustration describing an inverted crown shape roller.
Figure 3D:
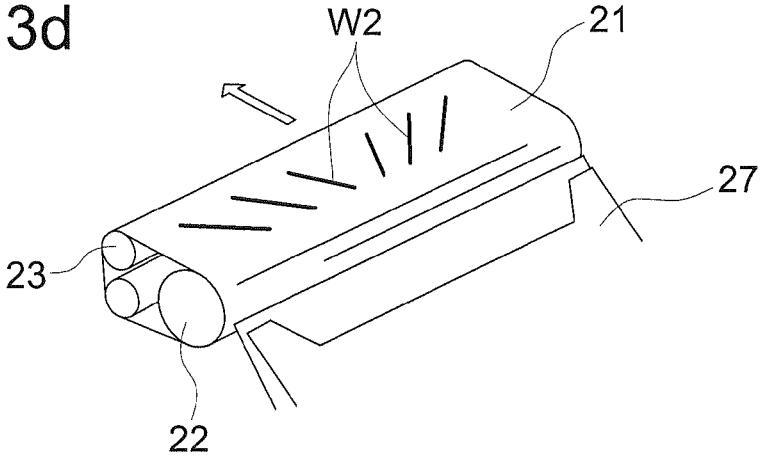
FIG. 3*d* is a schematic illustration describing the undulation phenomenon relating to the present invention.

On the other hand, in the present embodiment, as driving roller 23, used is an inverted crown shape roller in which the size of the central part is smaller than that of end portions as shown in FIG. 3*c*. In that way, when transfer belt 21 is rotationally driven without applying transfer electrical current, undulation W2 is generated in such a way that, as shown in FIG. 3*d*, it spreads outward from upstream of the belt traveling direction toward downstream. By providing a driving period without applying transfer electrical current before and after the transfer or in either of them so as to form this undulation W2 for a given length of time, undulation W1 is cancelled by undulation W2.

Namely, during application of transfer electrical current, transfer belt 21 is attracted to transfer roller 22 side by attraction between electric charges induced on the back surface of the transfer belt and electric charges on the transfer roller, and undulation W1 is about to be generated due to difference of electrostatic absorption power between at the central part and at the end parts. However, at the same time, undulation W2 is also generated by rotational driving of transfer belt 21 by driving roller 23 having the inverted crown shape, and, with this generation, undulation W1 is cancelled to some extent. However, the extent of the inverted crown shape can not be made so large in terms of the belt driving, and then the belt driving is continued even after the completion of the transfer (being completion of passing through a sheet of paper) while without application of transfer electrical current, thereby undulation W1 is completely cancelled by undulation W2.

In the present embodiment, the extent of the inverted crown shape was set such that the amount of crown was 0.1 mm with sizes of the end portion of driving roller 23 and the central portion being 16 mm being 15.9 mm, respectively. Tests were carried out using this driving roller 23, but even in a printing resistance test of one million sheets, image failure or breakage, which occurred when the present invention was not carried out, were not occurred. Further, even in tests using a roller having other inverted crown shape, in the case of a driving roller which drives a transfer belt of 300 mm in width, rollers, in which the size of the center was reduced to about 97 to about 99.5% of the size of the end portion, showed excellent results.

The roller which is formed in an inverted crown shape may be, in an embodiment, supporting roller 24 other than above driving roller 23. Further, in the case of a transfer unit of the other embodiments, a preferable roller has only to be properly selected and formed in an inverted crown shape.

In addition, not so long driving period without applying transfer electrical current is required, and, for example, it may be 2 to 3 seconds. In the case of a job in which a plurality of sheets are successively printed, one job is often carried out while applying transfer electrical current. In this case, after completion of the job, the rotational driving period may be set with transfer electrical current being turned off for a little longer time. Further, in this case, it is possible to turn off the transfer electrical current during a sheet passing through a transfer region with a prescribed interval during carrying out one job. Furthermore, during rotational driving of transfer belt in initializing an image forming apparatus after turning on the power of the apparatus, the job can be carried out with setting rotational driving time without applying transfer electrical current.

The present embodiments were described as above, but the present invention can also be applied to a monochrome image forming apparatus other than the above-described tandem type color image forming apparatus. In this case, since an intermediate transfer belt is not used, the transfer unit of the present invention becomes the primary transfer unit. As an image carrier, an intermediate transfer belt which bears a color toner image was used, but the intermediate transfer belt may have a drum shape. Then, in the case of a monochrome image forming apparatus, the image carrier can be a photoreceptor drum or a photoreceptor belt.

The present embodiment is designed so that, by generating undulation which generates during application of transfer electrical current and undulation in the reverse direction, the undulation during application of transfer electrical current is cancelled, and therefore, achieves the effect of providing an image forming apparatus which may not have image failure or breakage of a transfer belt.

What is claimed is:

1. An image forming apparatus comprising;

an image carrier carrying a toner image;

a transfer belt making pressure contact with the image carrier through a sheet of paper and transferring the toner image onto the sheet of paper;

a plurality of supporting rollers stretching and supporting the transfer belt; and a transfer roller, to which transfer electrical current is applied, making the transfer belt to make pressure contact with the image carrier from a back surface of the transfer belt, wherein one roller of the supporting rollers being arranged at downstream of the transfer roller and at a position where the sheet of paper is separated from the transfer belt is formed in an inverted crown shape, wherein a size of the center portion of the supporting roller is smaller than a size of the end portion of the supporting roller, and wherein the transfer belt is rotationally driven for a prescribed time, while the transfer electrical current is not applied on to the transfer belt, in both or either of before and after transfer of the toner image.

2. The image forming apparatus of claim 1, wherein the inverted crown shaped supporting roller among the plurality of the supporting rollers is a driving roller which rotationally drives the transfer belt.

3. The image forming apparatus of claim 1, wherein a modulus of elasticity of the transfer belt is 0.01 to 3 GPa.

4. The image forming apparatus of claim 1, further comprising a back up roller making a close contact with the back surface of the transfer belt at downstream of the transfer roller.

5. The image forming apparatus of claim 1, wherein the image carrier is an intermediate transfer member carrying a color toner image in which the toner images composed of a plurality of colors are superimposed.

6. An image forming apparatus comprising:

an image carrier carrying a toner image;

a transfer belt making pressure contact with the image carrier through a sheet of paper and transferring the toner image onto the sheet of paper;

a plurality of supporting rollers stretching and supporting the transfer belt;

a transfer roller, to which transfer electrical current is applied, making the transfer belt to make pressure contact with the image carrier from a back surface of the transfer belt; and a backup board urging the back surface of the transfer belt at downstream of the transfer roller wherein at least one roller of the supporting rollers is formed in an inverted crown shape, wherein a size of the center portion of the supporting roller is smaller than a size of the end portion of the supporting roller, and wherein the transfer belt is rotationally driven for a prescribed time, while the transfer electrical current is not applied on to the transfer belt, in both or either of before and after transfer of the toner image.

* * * * *